United States Patent [19]

Fortuna

[11] Patent Number: 4,575,987

[45] Date of Patent: Mar. 18, 1986

[54] APPARATUS FOR CLOSING A CONTAINER

[75] Inventor: Vincent E. Fortuna, Huntington Beach, Calif.

[73] Assignee: Vercon, Inc., Dallas, Tex.

[21] Appl. No.: 727,328

[22] Filed: Apr. 25, 1985

[51] Int. Cl.[4] ..... B65B 7/28; B65B 51/14

[52] U.S. Cl. ..... 53/298

[58] Field of Search ..... 53/297, 298, 373, 306, 53/478, 487

[56] References Cited

U.S. PATENT DOCUMENTS

| | | | |
|---|---|---|---|
| 2,799,981 | 7/1957 | Baker-Carr et al. | 53/478 |
| 3,491,510 | 1/1970 | Sternau | 53/297 X |
| 3,509,682 | 5/1970 | Logemann | 53/298 X |
| 3,792,566 | 2/1974 | Kinney | 53/298 |
| 4,176,507 | 12/1979 | Mancini | 53/478 |

*Primary Examiner*—Horace M. Culver

*Attorney, Agent, or Firm*—Roy L. Van Winkle; M. Norwood Cheairs

[57] ABSTRACT

The container closure and sealing apparatus includes opposed and oppositely rotating screw feeders for moving the containers from the feed conveyor to tacking apparatus which exerts sufficient force on a tape of pre-punched covers to dislodge a cover from the tape and temporarily secure the cover to the container. An infeed indexing apparatus works in timed coordination with the tacking apparatus and with the heat sealer to remove the containers from the screws and deposit the containers onto the heat sealer where localized heat is applied to the container and cover to perform the permanent sealing and securing of the cover to the container. The heat sealer transports the containers to an indexing ejector which works in timed relationship therewith to move the containers from the heat sealing assembly to a discharge conveyor.

8 Claims, 5 Drawing Figures

APPARATUS FOR CLOSING A CONTAINER

BACKGROUND OF THE INVENTION

This invention relates generally to improved apparatus for sealing and closing the open tops of containers.

More particularly, but not by way of limitation, this invention relates to an improved apparatus for closing and sealing the open top of a container with a cover having a heat responsive, adhesive polymer thereon.

Various types of apparatus have been proposed in the past for closing the open tops of containers. In some instances, the upper or open end of the container has been provided with a flange over which the cover is crimped when the cover is constructed from a material such as aluminum foil. In other instances, apparatus has been provided wherein the cover is spin welded, such as when a thermoplastic material is used for the cover. At times, the cover is attached to the container by some form of adhesive disposed between the cover and the container. Various degrees of success have been attained by the apparatus previously utilized.

This invention provides improved apparatus for sealing the open tops of such containers wherein it is immaterial whether the flange is provided about the periphery of the open end of the container or not and wherein it is immaterial what material is utilized to form the cover. To this end, the open end of the container is sealed by a cover that has an adhesive placed on the cover that will form a bond with the container.

It is an object of this invention to provide improved apparatus that provides a means for closing and sealing such containers at a high rate of speed and with great dependability.

SUMMARY OF THE INVENTION

Accordingly, this invention provides improved apparatus for closing and sealing the open top of a container with a cover having a heat responsive adhesive polymer thereon, the apparatus comprises: a housing; container feed means on the housing for receiving the containers and for positioning each container; cover applying means for locating a cover on each positioned container to close the open top; container discharge means; and, means for activating the adhesive polymer including means for moving the container from the container feed means to the discharge means.

BRIEF DESCRIPTION OF THE DRAWING

The foregoing and additional objects and advantages the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 2:
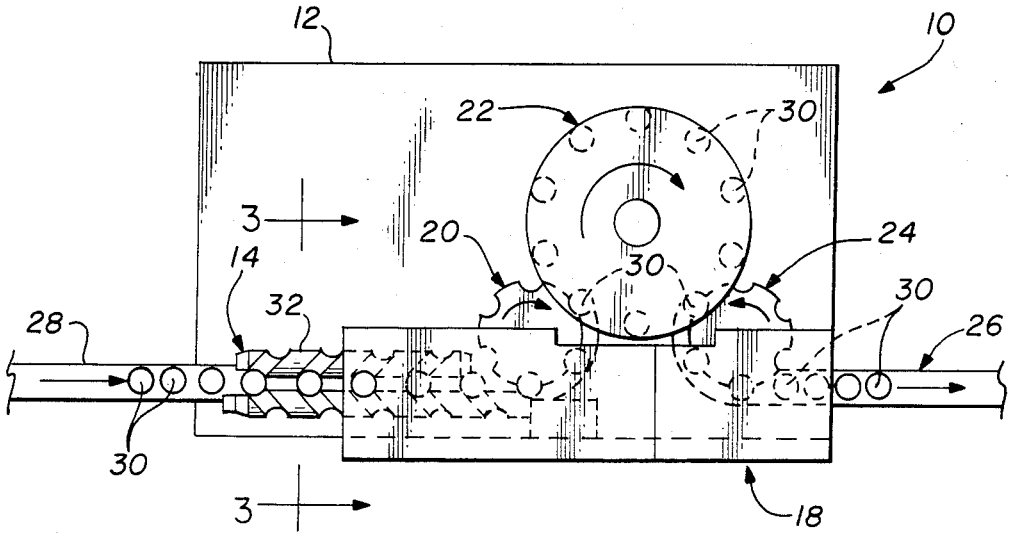
FIG. 2 is a schematic top plan view of the apparatus of FIG. 1.
Figure 1:
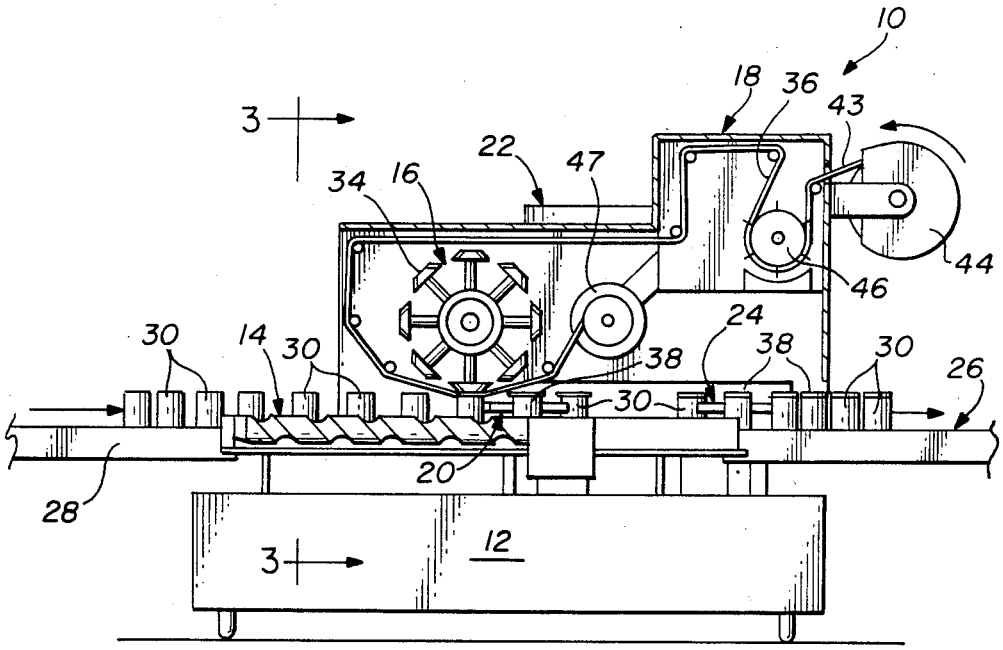
FIG. 1 is a somewhat schematic, elevation view of apparatus constructed in accordance with the invention.

Referring to the drawing in FIGS. 1 and 2 in particular, shown therein and generally designated by the reference character 10 is apparatus constructed in accordance with the invention for closing and sealing the open end of containers. As illustrated, the apparatus 10 includes a base or housing 12 having the following apparatus therein: a feed conveyor apparatus 14, a tacking assembly 16, a cover feed and punching mechanism 18 and indexing feeder 20 (See FIG. 2), a heat sealing assembly 22, an indexing assembly 24 and a discharge conveyor 26.

Figure 3:
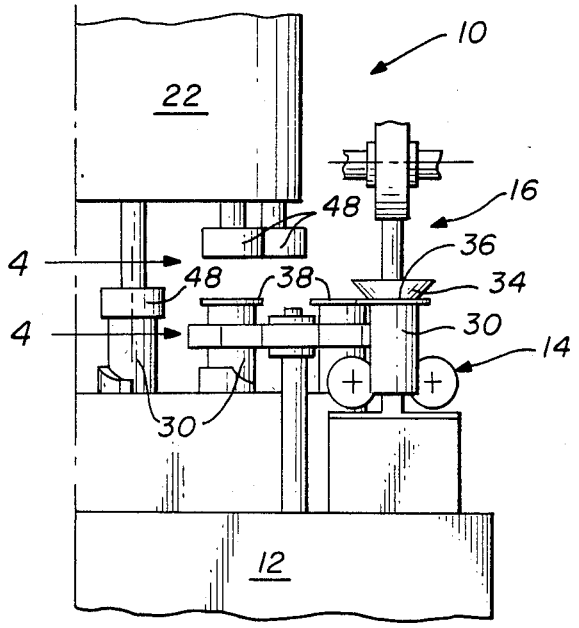
FIG. 3 is a view taken generally along the line 3—3 of FIG. 1.

In FIGS. 1, 2 and 3, it can be seen that the infeed conveyor apparatus 14 includes a feed conveyor mechanism 28 having a plurality of containers 30 thereon. The containers 30 are being directed into a pair of opposed and oppositely arranged feed screws 32 that function in timed relationship with the tacking assembly 16 so that the feet or pads 34 on the tacking assembly 16 are aligned with the containers 30 as they pass thereunder.

Figure 5:
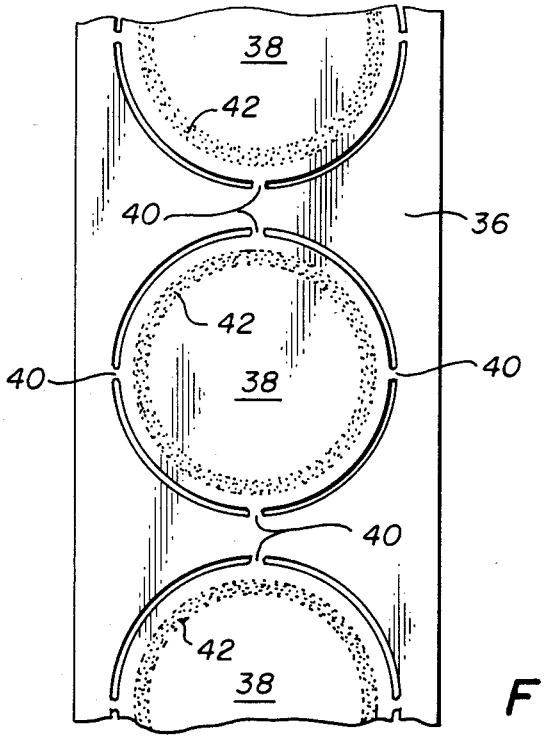
FIG. 5 illustrates a section of tape containing a prepunched cover that is used in the apparatus of this invention.

In FIG. 5, there is an enlarged illustration of a cover tape 36 which includes a plurality of prepunched covers 38. The covers are punched in the aluminum foil tape 36 and retained therein by a plurality of small tabs 40. Also, the covers 38 are coated adjacent to their periphery with an adhesive 42. The adhesive 42 is desirably Ethylene Vinyl Acetate if the containers 30 are manufactured from a plastic material such as polypropylene, polyethylene or polyethylene terephthalate. It is preferred that the adhesive 42 be one that is activated when heat is applied thereto to securely close and seal the containers 30. The tape 36 may of course, be of any desirable material, but for many applications, aluminum foil has proved to be entirely satisfactory.

A blank aluminum foil 43 tape can be seen in FIG. 1 extending from a roll into the cover feed and punching mechanism 18. The tape 43 is routed around the apparatus 18 by a plurality of idlers to a punching roll 46 where the tape 43 is punched to form the tape 36 having covers 38 punched therein as shown in FIG. 5. The prepunched tape 36 is then fed into the tacking apparatus 16. As the tape 36 passes through the apparatus, the pads 34 in the tacking assembly 16 exert enough force downwardly on the tape 36 and upon the containers 30 to dislodge the covers 38 from the tape 36 and temporarily secure the covers 38 to the containers 30. The tape 36 with the covers 38 punched therefrom is then reeled onto a reel 47 from which the punched out tape is removed for disposal.

The indexing feeder 20 engages each of the containers 30 (See FIG. 2) as they come out from under the tacking assembly 16 and out of the feed screws 14. The indexing feeder 20 rotates in such a manner as to position each of the containers 30 on the heat sealing assembly 22 under one of the pistons 48 carried thereby.

The heat sealing assembly 22, or at least a portion thereof, is rotating in timed relationship with the indexing feeder 20 to move the containers 30 from the indexing feeder to the indexing ejector 24. The pistons or plungers 48 on the heat sealing assembly 22 move downwardly to engage the covers 38 located on the upper end of the containers 30.

Figure 4:
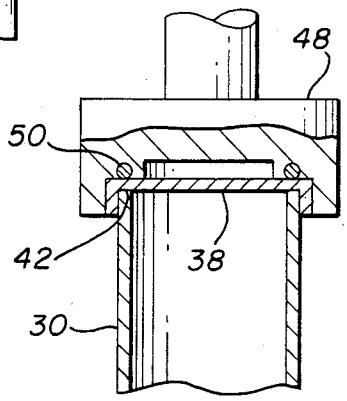
FIG. 4 is an enlarged fragmentary, cross-sectional view taken generally along the line of 4—4 of FIG. 3.

As illustrated in FIG. 4, the plunger 48 deforms the peripheral edge of the cover 38 downwardly over the outside of the container 30. Heating electrodes or other suitable heating means 50 is located in the plungers 48 and, when activated, causes local heating of the cover 38 and of the adhesive 42 thereon so that the cover 38 adheres to and seals the upper open end of the container 30. The traverse time in the heat sealer is designed to provide total and complete sealing of the containers 30.

Upon reaching the indexing ejector 24, the containers are moved thereby from the heat sealing assembly 22. The containers 30 are moved onto the discharge conveyor 26. As previously mentioned, the screws 14 operate in timed relationship with the tacking assembly 16, the indexing feeder 20, the heat sealer 22 and the indexing ejector 24 so that a minimal amount of time required to close and seal the containers 30 occur as a container 30 moves through the apparatus 10.

OPERATION OF THE PREFERRED EMBODIMENT

The containers 30 have been filled by appropriate filling apparatus and discharged onto the feed conveyor 28 and, as the containers 30 are moved by the conveyor 28, they enter the feed screws 14. The screws 14 move the containers 30 under the tacking assembly 16 and under the cover tape 36. At this point, downward force is applied by the pads 34 on the tacking assembly 16 causes one of the covers 38 to be severed from the tape 36 and temporarily located on the container 30.

Upon leaving the tacking assembly 16 and feed screws 14, the containers 30 are picked up by the indexing feeder 20 which deposits the containers onto the heat sealing assembly 22. The containers 30 are carried thereby to the indexing ejector 24.

During the traverse of the containers 30 between the indexing feeder 20 and the indexing ejector 24, the plungers or pistons 48 move downwardly into engagement with the covers 38 and with the upper end of the containers 30. Heat is applied by the electrical conductors 50 or other suitable means to locally heat the cover 38, the adhesive 42 thereon and the upper peripheral edge of the containers 30 causing the covers 38 to be securely and sealingly attached thereto. From the indexing ejector 24, the containers 30 are discharged onto the discharge conveyor so that the containers 30 can then be packed into appropriate cartons.

Thus, it can be appreciated from the foregoing detailed description that the closure and sealing apparatus described herein is effective and efficient to provide quick and thorough closure and sealing of the containers.

Having described but a single embodiment of the invention, it will be understood that many changes and modifications can be made thereto without departing from the spirit or scope of the invention and the annexed claims.

What is claimed is:

1. Improved apparatus for closing and sealing the open top of a container with a cover having a heat responsive adhesive polymer thereon, said apparatus comprising in combination:

a housing;

container feed means on said housing for receiving the containers and for positioning each container;

cover applying means on said housing for locating a cover on each positioned container to close the open top;

container discharge means; and, means for activating said adhesive polymer including means for moving said container from said container feed means to said discharge means.

2. The apparatus of claim 1 wherein said container feed means comprises:

a feed conveyor; and, an indexing feeder for moving said containers in spaced relation from said conveyor to said means for activating said adhesive polymer.

3. The apparatus of claim 1 wherein said container discharge means comprises:

a discharge conveyor; and, an indexing ejector for moving said containers from said means for activating said adhesive polymer to said discharge conveyor.

4. The apparatus of claim 1 wherein said means for activating said adhesive polymer comprises:

transfer means for receiving said containers from said feed means and said cover applying means and moving said containers to said discharge means; and, heating means engaging said covers for locally heating said covers adjacent the periphery of the open top of each said container activate said heat responsive adhesive polymer bonding said covers to said containers.

5. The apparatus of claim 1 wherein said cover applying means includes:

cover feed means for positioning one of said covers adjacent to the open top of each said container; and, force applying means engageable with said covers for temporarily securing said covers to said containers.

6. Improved apparatus for closing and sealing the open top of a container with a cover having a heat responsive adhesive polymer thereon, said apparatus comprising in combination:

a housing;

container feed means on said housing for receiving the containers and for positioning each container, said feed means including a feed conveyor, and an indexing feeder for moving said containers in spaced relation from said conveyor to said means for activating said adhesive polymer;

cover applying means on said housing for locating a cover on each positioned container to close the open top;

means for activating said adhesive polymer;

container discharge means including a discharge conveyor, and an indexing ejector for moving said containers from said means for activating said adhesive polymer to said discharge conveyor; and, said means for activating said adhesive polymer including means for moving said container from said container feed means to said discharge means.

7. Improved apparatus for closing and sealing the open top of a container with a cover having a heat responsive adhesive polymer thereon, said apparatus comprising in combination:

a housing;

container feed means on said housing for receiving the containers and for positioning each container, said feed means including a feed conveyor, and an indexing feeder for moving said containers in spaced relation from said conveyor to said means for activating said adhesive polymer;

cover applying means on said housing for locating a cover on each positioned container to close the open top, said cover applying means including cover feed means for positioning one of said covers adjacent to the open top of each said container, and force applying means engageable with said covers for temporarily securing said covers to containers;

means for activating said adhesive polymer;

container discharge means including a discharge conveyor, and an indexing ejector for moving said containers from said means for activating said adhesive polymer to said discharge conveyor; and, said means for activating said adhesive polymer including means for moving said container from said container feed means to said discharge means.

8. Improved apparatus for closing and sealing the open top of a container with a cover having a heat responsive adhesive polymer thereon, said apparatus comprising in combination:

a housing;

container feed means on said housing for receiving the containers and for positioning each container, said feed means including a feed conveyor, and an indexing feeder for moving said containers in spaced relation from said conveyor to said means for activating said adhesive polymer;

cover applying means on said housing for locating a cover on each positioned container to close the open top, said cover applying means including cover means for positioning one of said covers adjacent to the open top of each said container, and force applying means engageable with said covers for temporarily securing said covers to said containers;

means for activating said adhesive polymer;

container discharge means including a discharge conveyor, and an indexing ejector for moving said containers from said means for activating said adhesive polymer to said discharge conveyor; and, means for activating said adhesive polymer including transfer means for receiving said containers from said feed means and said cover applying means and moving said containers to said discharge means, and, heating means engaging said covers for locally heating said covers adjacent to the periphery of the open top of each container to activate said heat responsive adhesive polymer bonding said covers to said containers.

* * * * *